United States Patent [19]

Wyeth et al.

[11] 4,035,851

[45] July 19, 1977

[54] URINALS

[75] Inventors: Harold G. Wyeth, Ringwood; John L. T. B. Gmach, Fordingbridge, both of England

[73] Assignee: Ashford Marine (J. L. Gmach) Limited, Fordingbridge, England

[21] Appl. No.: 684,316

[22] Filed: May 7, 1976

[30] Foreign Application Priority Data

May 8, 1975 United Kingdom ..... 19497/75

[51] Int. Cl.[2] ..... E03D 13/00

[52] U.S. Cl. ..... 4/99; 4/42

[58] Field of Search ..... 4/1, 99, 100, 101, 103, 4/104, 102, 105, 106, 107, 108, 109, 42

[56] References Cited

U.S. PATENT DOCUMENTS

| | | | |
|---|---|---|---|
| 755,150 | 3/1904 | Major | 4/99 |
| 847,183 | 3/1907 | Johnson | 4/100 |
| 1,366,761 | 1/1921 | Adell | 4/100 |
| 1,461,284 | 7/1923 | Newton | 4/100 |
| 2,983,927 | 5/1961 | McCann | 4/109 |

FOREIGN PATENT DOCUMENTS

| | | | |
|---|---|---|---|
| 2,204,317 | 10/1973 | Germany | 4/104 |
| 572,402 | 1/1958 | Italy | 4/99 |

*Primary Examiner*—Henry K. Artis

*Attorney, Agent, or Firm*—Larson, Taylor and Hinds

[57] ABSTRACT

A urinal is formed along the upper part of its face with a shaped horizontal recess which is approximately V-shaped when seen in section, and is perforated with a horizontal row of holes at the apex of the V communicating with a reservoir in the form of an integral channel extending for the whole length of the urinal to the rear of the recess, so that water from the reservoir emerging through the holes flows over the lower surface of the recess before passing to the face of the urinal. The reservoir may be closed at the top and of generally triangular cross-section above the line of holes. The urinal may include a cistern connected to the reservoir by way of a syphon and forming an integral part of the assembly which may be formed as an integral moulding of glass-reinforced plastics material, or may be fabricated from stainless steel.

11 Claims, 2 Drawing Figures

URINALS

This invention relates to urinals and is particularly concerned with flushing arrangements. In most constructions the urinal is connected to a cistern by pipes and for flushing purposes, water is conveyed via these pipes to the top of the urinal and projected under pressure through projections, buttons or perforated pipes onto the upright surface of the urinal. Such a system of direct flushing may be both noisy and uneven and the buttons or projections, if included, can make cleaning difficult.

According to the present invention, a urinal is formed along the upper part of its face with a shaped horizontal recess perforated with a horizontal row of holes communicating with a reservoir running along the urinal to the rear of the recess so that water from the reservoir emerging through the holes flows over the lower surface of the recess before passing to the face of the urinal. As a consequence, water fed into the reservoir from a cistern emerges through the holes or openings during flushing and runs over the lower surface of the recess and onto the face of the urinal without being projected forwardly or away from the face of the urinal.

The recess is perferably approximately V-shaped when seen in section, with the row of holes at the apex of the V. The lower surface of the recess may be defined by a step having a substantially horizontal portion adjacent to the row of holes. During flushing, the water flows over the step and down the face of the urinal as described above.

A construction in accordance with the invention enables the urinal to be designed in such a way that the face of the urinal slopes backwardly, thus allowing room at the top for the cistern to be included within the existing depth of the unit. Such an arrangement also eliminates the drips which otherwise frequently pass into the bowl after flushing and cause splashing.

The reservoir is conveniently in the form of an integral channel extending for the whole length of the urinal and may be closed at the top, being of generally triangular cross-section above the line of holes. In order to incorporate the reservoir as an integral part of the assembly, the urinal is formed as a moulding, for example of glass-reinforced plastic. Combining the reservoir with the remainder of the urinal in this way cuts out all conventional plumbing using pipes and spreader buttons and also cuts out the necessity of a separate cistern mounted at a sufficient height above the urinal to obtain the necessary flushing pressure. With a construction in accordance with the invention, the cistern may form an integral part of the assembly and if the construction is moulded, the cistern may form part of the same moulding.

An example of an urinal in accordance with the invention will now be described in more detail, by way of example, with reference to the accompanying drawings, in which.

Figure 1:
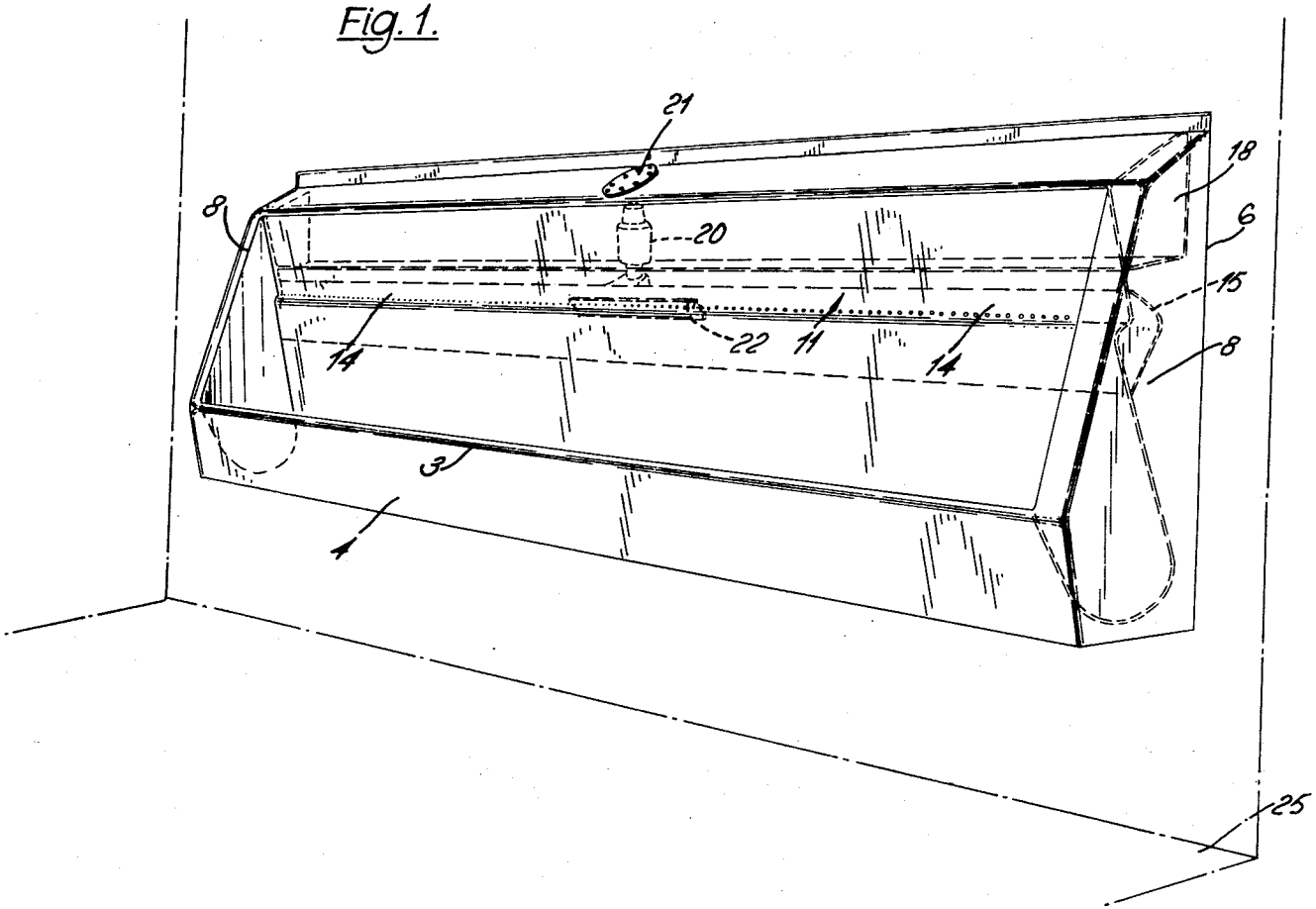
FIG. 1 is a perspective view.

The urinal constitutes a self-contained unit having a rearwardly sloping face 1 which merges into the surface of a rounded trough 2 connected to a drain (not shown). The trough 2 terminates in a lip 3 from which the outer surface of the unit continues downwardly at 4, rearwardly at 5 and then upwardly at 6 to form a generally rectangular casing for the unit as a whole, which is completed by end panels 8. The upper part of the face 1 is formed with a horizontal recess 11 which is approximately V-shaped when seen in section in FIG. 2 and of which the lower surface 12 defines a step having a substantially horizontal portion. The apex of the V is perforated by a horizontal row of holes 14, best seen in FIG. 1. These holes communicate with a reservoir 15 which runs along the length of the urinal to the rear of the recess 11 so that when the reservoir is filled with water, it overflows through the holes 14.

Figure 2:
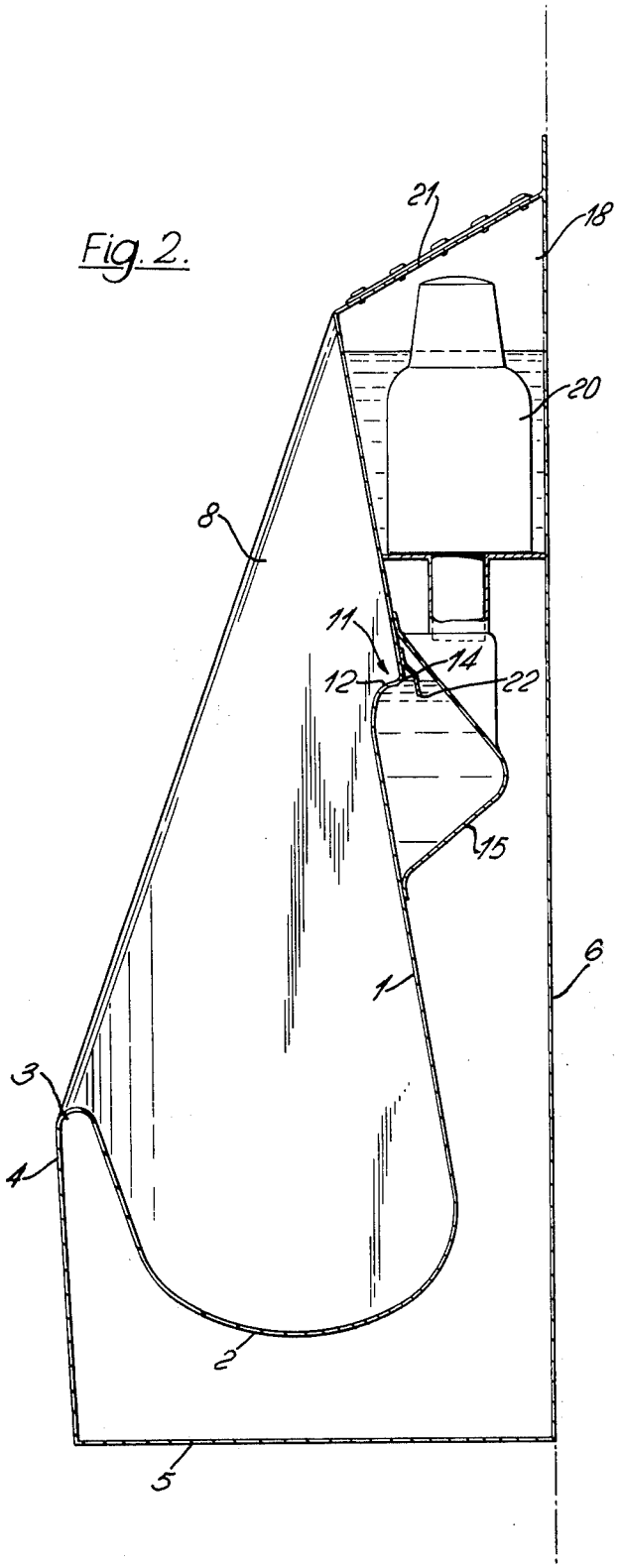
FIG. 2 is a sectional end view to an enlarged scale.

FIG. 2 illustrates the static condition between flushing operations in which water in the reservoir 15 is in a static condition at a level defined by the row of holes 14. Water is supplied to the reservoir 15 from a cistern 18 which also forms part of the unit, lying behind the upper part of the face 1. The cistern 18 is connected to the reservoir 15 by way of an automatic syphon 20 located at the middle of the length of the unit as best seen in FIG. 1. The syphon 20 is enclosed within the casing, but is provided with an inspection cover 21.

As can be seen from FIG. 2, the upper part of the reservoir 15 is of generally triangular cross-section so that when flushing starts and the water level in the reservoir rises above that shown in FIG. 2, the rate of rise is accelerated due to the shape of the reservoir, thus assisting in obtaining a good initial flush. A baffle 22 is fitted behind the holes 14 in the immediate area of the syphon 20 so as to help to even out the flow of water and prevent excessive local flow in the region of the syphon. As the water level rises, it overflows through the holes 14, this overflow occurring equally over the whole width of the unit, thus producing an even flush over the whole face of the urinal. The inclusion of the flat, substantially horizontal area of the step 12 just in front of the holes 14 has the effect of spreading the flow of water so that it sheets down the face 1 rather then flowing in individual streams from the separate holes 14. In order to prevent the build-up of pressure as water rises in the upper part of the reservoir, small vent holes (not seen in the drawing) are provided along the upper part of the reservoir. This prevents the water emerging from the holes 14 with excessive pressure and also eliminates any risk of back pressure on the syphon 20. As a result of the combination of features just described, the flushing operation consists of a steady, even flow of water along the length of the urinal without splashing and, in addition, the unit has a smooth exterior surface free of any buttons or other projections so that cleaning is greatly facilitated.

As seen from FIG. 1, the unit illustrated is intended to be wall-hung, being spaced from floor level illustrated as 25. If required, however, the unit can be extended downwardly so as to stand on the floor. Most conveniently, the unit as a whole is moulded from glass-reinforced plastics material, but in some circumstances it may be preferable to fabricate it from stainless steel. Although the cistern 18 is illustrated as forming an integral part of the unit, this is not essential and if, for example, the unit is intended to replace a conventional urinal where a cistern already exists at a high level, this can be connected directly to the reservoir 15 so that no cistern is required in the unit itself.

We claim:

1. A urinal having a generally vertical face with a trough at its lower end, said face being formed along the upper part thereof with a shaped horizontal recess, said recess being perforated with a horizontal row of holes, a reservoir adapted for connection to a water supply and communicating with said recess through said holes such that flushing water can pass from said reservoir through said holes to said horizontal recess and thence to said face, said reservoir extending along said urinal generally to the rear of said recess, whereby water from said reservoir emerging through said holes flows over the lower surface of said recess before passing to the face of said urinal to effect flushing of said face and said trough.

2. A urinal according to claim 1, in which said recess is approximately V-shaped when seen in section, with the row of holes at the apex of the V.

3. A urinal according to claim 1, in which the lower surface of said recess is defined by a step having a substantially horizontal portion adjacent to the row of holes.

4. A urinal according to claim 1 in which said face slopes rearwardly below said recess.

5. A urinal according to claim 1 in which said reservoir is in the form of an integral channel extending for the whole length of the urinal.

6. A urinal according to claim 5 in which said reservoir is closed at the top and is of generally triangular cross-section above said line of holes.

7. A urinal according to claim 6, in which the upper part of said reservoir is formed with vent holes.

8. A urinal according to claim 1 and including a cistern, said cistern being connected to said reservoir and forming an integral part of said urinal.

9. A urinal according to claim 8 and including a syphon, said syphon connecting said cistern to said reservoir.

10. A urinal according to claim 9 including a baffle, said baffle being fitted behind said row of holes in the region of said syphon.

11. A urinal according to claim 1 formed as an integral moulding of glass-reinforced plastics material.

* * * * *